United States Patent [19]

Graves

[11] 4,204,611

[45] May 27, 1980

[54] APPARATUS FOR CHRONOLOGICALLY DISPENSING TABLETS

[76] Inventor: Joel S. Graves, 14376 Eddy Lake Rd., Fenton, Mich. 48430

[21] Appl. No.: 898,307

[22] Filed: Apr. 20, 1978

[51] Int. Cl.² ..... B65D 83/04

[52] U.S. Cl. ..... 221/5; 206/534; 206/538; 221/82

[58] Field of Search ..... 221/2, 5, 82; 116/121; 206/533, 534, 538, 539

[56] References Cited

U.S. PATENT DOCUMENTS

| | | | |
|---|---|---|---|
| 1,680,130 | 8/1928 | Conner | 221/82 X |
| 3,675,620 | 7/1972 | Baustin | 116/121 |
| 3,926,335 | 12/1975 | Dangles et al. | 221/82 |
| 4,117,952 | 10/1978 | Grimes | 221/5 |

FOREIGN PATENT DOCUMENTS

| | | | |
|---|---|---|---|
| 1227370 | 8/1960 | France | 206/538 |

*Primary Examiner*—F. J. Bartuska
*Attorney, Agent, or Firm*—John J. Swartz

[57] ABSTRACT

A product dispenser for dispensing products, such as tablets, on a time related schedule, or randomly as desired, comprising a generally cylindrical product receiving magazine having a plurality of axially spaced groups of circumferentially spaced, radially outwardly opening, product receiving pockets which are generally in axial alignment with the pockets of adjacent groups to form circumferentially spaced rows of pockets; a plurality of product retaining rotatable rings mounted on the magazine in radial alignment with the pockets for retaining the tablets in the pockets; each ring including a tablet dispensing aperture therethrough adapted to be moved into alignment with a selected one of the pockets; a plurality of axially spaced indicia, representing the days of the week, lying in the planes of the groups of pockets; and circumferentially spaced indicia, representing different time periods throughout the day, generally longitudinally aligned with the rows of pockets.

14 Claims, 5 Drawing Figures

APPARATUS FOR CHRONOLOGICALLY DISPENSING TABLETS

BACKGROUND OF THE INVENTION

This invention relates to a product dispensing apparatus for dispensing a variety of pills at various times. More particularly, this invention relates to a tablet dispensing device which will assist the user in recalling whether he has or has not ingested tablets at appropriate times.

It is an object of the present invention to provide a self-loading device for use in chronologically dispensing tablets.

It is another object of the present invention to provide an apparatus for use in chronologically dispensing tablets for aiding the user in insuring that only certain tablets are ingested at certain times during certain days.

Yet another object of the present invention is to provide apparatus for use and chronologically dispensing tablets having a tablet receiving magazine including a plurality of axially spaced groups of radially outwardly opening tablet receiving pockets and a plurality of individually rotatable, tablet retaining and dispensing rings for retaining the tablets in the pockets and yet permitting tablets in selected pockets to be dispensed.

Another object of the present invention is to provide pill dispensing apparatus of the type described for use by individuals who have a plurality of different tablets, some of which are to be ingested at the same time and some of which are to be ingested at different times during various time periods during a week.

A still further object of the present invention is to provide tablet dispensing apparatus of the type described including a plurality of axially spaced groups of tablet receiving pockets which are axially aligned with the pockets of adjacent groups, and closure rings concentrically mounted on the magazine having tablet dispensing openings therein for registry with selected openings of the magazine.

Other objects and advantages of the present invention will become apparent to those who are unskilled in the art as the description thereof proceeds.

SUMMARY OF THE INVENTION

Apparatus for use in chronologically dispensing tablets comprising a tablet magazine including a plurality of axially disposed groups of annularly arranged radially outwardly opening, tablet receiving pockets; a plurality of axially disposed, closure rings mounted on a magazine in transverse alignment with the groups of pockets for retaining tablets in the pockets; a first plurality of axially disposed, time related indicia disposed on one of the plurality of rings or the magazine, generally in transverse alignment with the groups of pockets; a second plurality of annularly arranged, time related indicia disposed on the magazine, generally longitudinally aligned with the pockets; the rings being individually incrementally rotatable about the axis and including a tablet dispensing opening therein such that one of said openings can be moved into radial registry with any selected one of the pockets to allow a tablet in the selected pocket to be radially dispensed.

These and other objects of the present invention may more readily be understood by reference to the accompanying drawings in which.

DESCRIPTION OF PREFERRED EMBODIMENT

Figure 2:
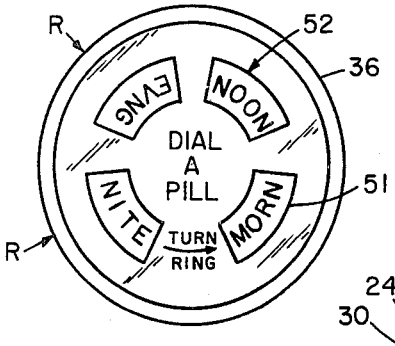
FIG. 2 is a top plan view thereof taken along the line 2—2 of FIG. 1.

Apparatus constructed according to the present invention, is generally designated 10, and includes a one-piece, tablet receiving magazine, generally designated 12, having a base 14 mounting an upstanding cylinder 16. The cylinder or column 16 includes a continuous pocket forming web or sheet 17 of thermoplastic material defining a plurality of axially spaced layers or groups 18 of circumferentially spaced, concentric, radially outwardly opening, tablet receiving pockets 20. More particularly, the groups 18 include seven axially spaced groups **18*a*–18*g* of pockets 20. Each group or set 18 includes four angularly spaced, tablet receiving pockets 20 which are vertically aligned with the pockets 20 of each of the other groups or sets 18** to form pocket rows R.

Figure 3:
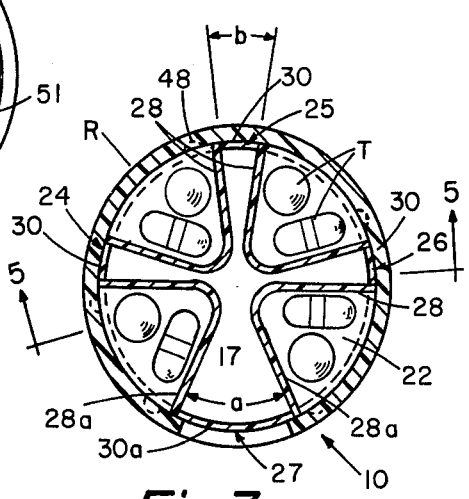
FIG. 3 is a sectional plan view, taken along the line 3—3 of FIG. 1.
Figure 4:
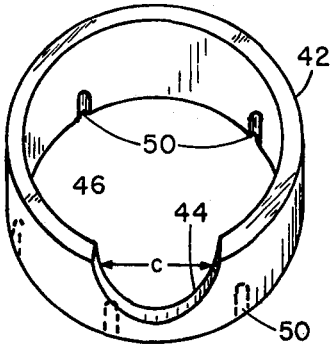
FIG. 4 is a perspective view illustrating one of the tablet retaining rings.

Each group 18 of the pocket forming sheet 17 includes four equi-angularly disposed pocket separating portions 24, 25, 26, and 27, spanned by upper and lower pocket defining portions 29 and 31 spanned by circumferentially curvilinear wall portions 33. Each of the pocket separating portions 24, 25, and 26 are substantially identical in top plan cross section, as illustrated in FIG. 3, and include radially outwardly diverging, confronting webs 28 spanned at the radially terminal ends thereof by curvilinear identical webs 30. The pockets separating portion 27 has a greater circumferential extent than the pockets separating members 24, 25, and 26, and includes radially outwardly diverging confronting webs **28*a* spanned at the radially terminal edges thereof by a curvilinear web 30*a* which has a circumferential length a which is substantially longer than the circumferential length b of the webs 30. The webb 22 thus defines pocket defining side walls 28 and 28*a*, terminating in curvilinear outer walls 30 and 30*a* respectively, and spanned by integral, upper and lower confronting wall sections 29 and 31 terminating in curvilinear walls 33**.

The upper end of the column 12 includes an integral, hollow projection 34 removably mounting a retaining cover 36 which is cemented thereon. The retaining ring 36 includes an annular retaining lip 38 for a purpose to be immediately described.

A first plurality of indicia 40 is provided on the outer face of the curvilinear web **30*a*. The indicia 40 comprises axially spaced abbreviations "MON", "TUES", "WED", "THU", "FRI", "SAT", "SUN", which are abbreviations for the days of the week, Monday through Sunday, and lie in the planes P of the pockets 20 in each group 18*a*–18*g***.

A plurality of axially stacked, transparent, closure or tablet retaining rings 42 is mounted on the magazine 12 in vertically stacked, abutting relation between the base and the retaining lip 38. The rings 42 are individually rotatable and secure one or more tablets T in the pockets 20. Each of the closure rings 20 includes a tablet dispensing aperture 44 therein of sufficient size to permit a tablet T to be dispensed therethrough when the ring 42 is in radial registry with a pocket 20. The aperture 44 is molded into the upper edge 46 of the ring 42. The maximum circumferential width c of the dispensing opening 44 is greater than the circumferential length b of the web 30 and less than the circumferential length a of the web 30a.

The cylindrical column 16 includes a plurality of axially spaced radially outwardly projecting detents 48 projecting from the curvilinear walls 33, and each of the rings 42 includes a plurality of circumferentially spaced, radially inwardly relieved, detent receiving recesses 50 for releasably receiving the detents 48. When one of the detents 48 is received in one of the recesses 50, rotation of the ring 42 is inhibited. The web 22 is yieldable laterally inwardly when the ring 42 is rotated so that the detent 48 will move radially inwardly and escape the recess 50 when sufficient circumferential rotating force is applied to the ring 42. Five detent receiving recesses 50 are provided in each ring and are so located that when the detent 48 is received in a recess 50, the tablet dispensing opening 44 will either be aligned with one of the pockets 20 or with the indicia bearing face 30a.

A plurality of circumferentially spaced, indicia receiving paper blanks 51 are mounted on the end surface of retaining cover 36 via a layer of adhesive 53. The blanks 51 receive indicia 52, indicating different time periods through the day. More particularly, the indicia 52 comprises "MORN", "NOON", "EVNG", and "NITE", representing morning, noon, evening, and bedtime time periods respectively. Any other time increments may be utilized as desired. These indicia are marked by the user according to his requirements. The indicia receiving blanks 51 and the indicia 52 are in axial or longitudinal alignment with the pockets 20 of the vertically spaced pocket rows R.

THE OPERATION

In operation, it will be assumed that the user will be required to ingest a plurality of different tablets T, seven days per week. It will further be assumed that the user will be required to ingest the tablets at morning, noon, evening, and bedtime periods, however, not all of the different tablets are to be ingested at each time period throughout a given day. Some of the tablets are to be ingested at the same time, for example, noon, and others of the tablets are to be ingested at different times, for example, morning and evening.

The user will initially manually load the magazine by initially rotating the uppermost ring 40 adjacent the indicia "MON" into alignment with one of the pockets 20 in pocket group 18a underlying the indicia "MORN". At this time, the detent 48 adjacent the uppermost ring will be received by one of the recesses 50 in the uppermost ring 40. A suitable quantity and type of tablets T are inserted radially inwardly through the opening 44 to be received by the pocket 20. The operator will then index the ring 40 until the pocket 44 is in radial registry with the circumferentially adjacent pocket 20 underlying the indicia "NOON". He will then radially insert a suitable quantity and type of tablets T into this pocket. The operator will then rotate the ring 40 to remove the detent 48 from the recess 50 until the opening 44 in the uppermost ring is in radial registry with the pocket 20 underlying the indicia "EVNG". The user will then insert a suitable quantity and type of tablets T into this pocket. The operator will once again rotate the ring 40 to a position in which the aperture 44 is in radial alignment with a pocket 20 underlying the indicia "NITE". After suitable quantity and type of tablets T have been inserted into this pocket, the ring 40 will then be rotated to a position in which the aperture 44 is aligned with the indicia bearing wall 30a.

Figure 1:
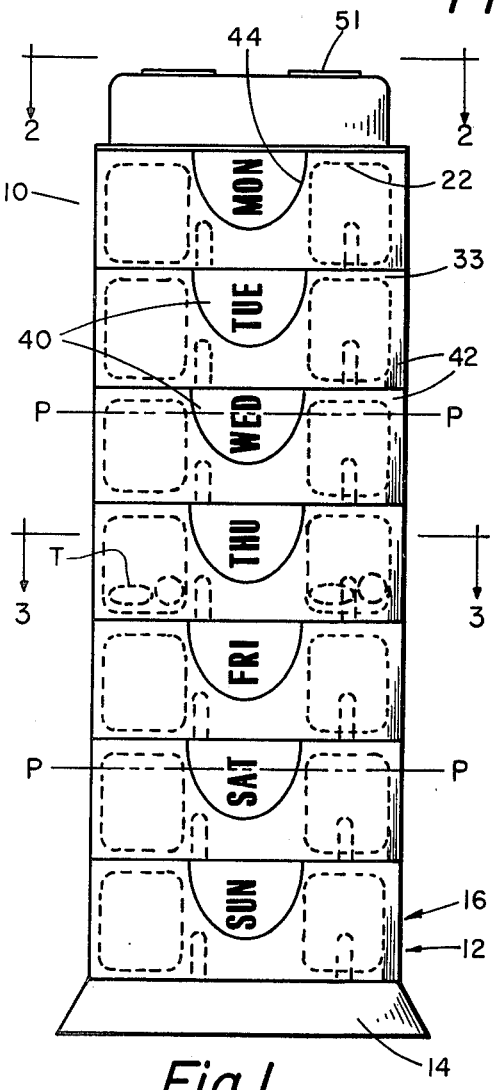
FIG. 1 is the side elevational view of apparatus constructed according to the present invention.
Figure 5:
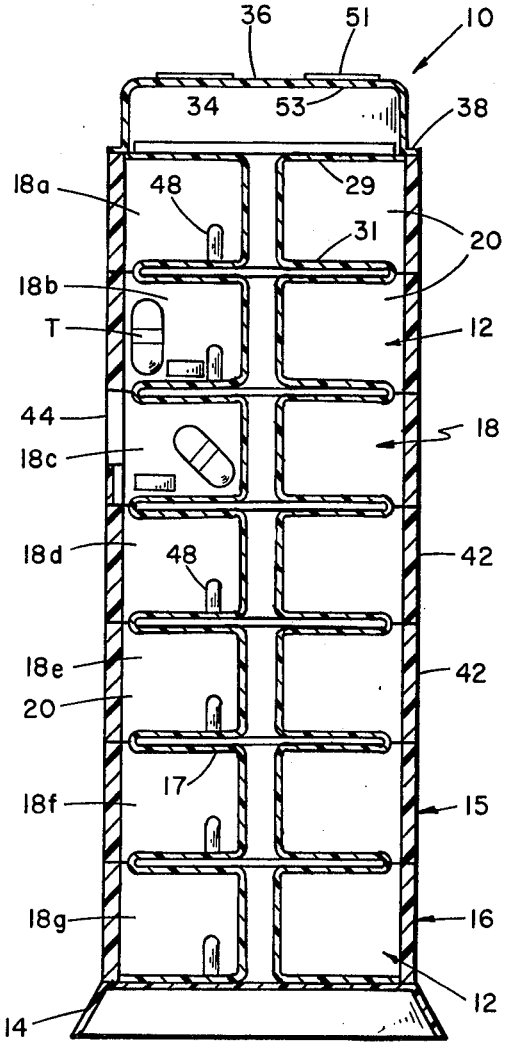
FIG. 5 is a sectional side view, taken along the line 5—5 of FIG. 3.

The user will then similarly successively index each successive ring 40 so that the apertures 40 are brought into alignment with the respective pockets so that suitable tablets can be placed in the remaining pockets. Some of the pockets may remain empty if no tablets are to be ingested at the time assigned to the pocket. When the loading is completed, the rings will be in the position illustrated in FIG. 1.

To dispense tablets, the user, for example, on Monday morning would rotate the ring 40 until the aperture 44 is in alignment with the pocket 20 of pocket group 18g, underlying the indicia "MORN". Any tablets in this pocket are then dispensed radially outwardly through the opening 44 by merely tipping the column 16 on its side, so that the tablets move therethrough by gravity forces. The opening 44 may remain in a position aligned with the empty pocket or returned to the start position to keep all pockets closed. At noon time, the user will then index the uppermost ring 40 until the aperture 44 therein is in radial registry with the pocket 20 underlying indicia "NOON". This sequence will be repeated at evening and night times for the remaining two pockets in the uppermost group 18. On Tuesday, the second uppermost ring 40 will be similarly successively indexed to each successive time period in the day. For each successive day of the week, the rings will be similarly rotated.

The apparatus will provide a ready visual indication as to whether or not the user has ingested the pills at the appointed times. In the event that the user inadvertently forgets to ingest the pills on Monday noon, for example, the user, on Monday afternoon, will be able to see through the uppermost transparent ring 20 to view the tablets T in the pocket 20 which is radially aligned with the indicia "MON" and axially aligned with the indicia "NOON". If the user views tablets in the pocket, he will know that he forgot to take the tablets and will ingest them accordingly.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for use in chronologically dispensing tablets comprising:

a cylindrical tablet magazine, having a longitudinal axis, including a plurality of axially disposed, groups of annularly arranged, radially outwardly opening, tablet receiving pockets;

said pockets in each group being axially aligned with the pockets in the adjacent groups to form axially aligned pocket rows;

a plurality of axially abutting, annular closure rings mounted on the radially outer surface of said magazine in transverse alignment with said groups of pockets for retaining tablets in said pockets, each of said rings including a radial opening therethrough for radially registering with selected ones of said pockets;

a first plurality of axially disposed time related indicia, disposed on one of said transverse plurality of rings and said magazine, generally in alignment with said groups of pockets; and a second plurality of annularly arranged time related indicia receiving means disposed on said magazine axially adjacent the ends of said pocket rows;

said rings being individually incrementally rotatable about said axis such that a selected one of said openings can be moved into radial registry with a selected one of said pockets to allow any tablets in said selected pocket to be radially dispensed.

2. The apparatus for use in chronologically dispensing tablets set forth in claim 1 wherein one of said annularly arranged indicia is in axial alignment with each of said rows of pockets.

3. The apparatus set forth in claim 1 wherein said rings and said magazine include cooperating detent means and detent receiving means to releasably secure said rings in positions in which said openings are radially aligned with any selected ones of said pockets.

4. The apparatus set forth in claim 3 wherein said first plurality of indicia corresponds in number to the number of groups of pockets and said second plurality of indicia receiving means correspond in number to the number of pockets in each group.

5. The apparatus set forth in claim 4 wherein said first plurality of indicia correspond in number to, and indicate the days of, a week; said second plurality of indicia receiving means includes indicia indicating different time periods during a day.

6. The apparatus set forth in claim 5 wherein said rings are transparent.

7. The apparatus set forth in claim 6 wherein said pockets in each group are circumferentially spaced and lie in a radial plane, the plane of each group being axially spaced from the planes of the axially adjacent groups.

8. The apparatus set forth in claim 3 wherein said magazine includes a plurality of pocket separating portions, each having radially outwardly projecting walls, spanned at the radially outer ends thereof, by a curvilinear wall; one of said curvilinear walls bearing said first plurality of indicia and having a circumferential length greater than the circumferential length of at least one of the other curvilinear walls.

9. The apparatus set forth in claim 8 wherein said magazine comprises a unitary web of thermoplastic material including a plurality of sets of circumferentially spaced, radially outwardly diverging web portions, constituting said radially outwardly projecting walls, spanned by an integral circumferentially extending web portion constituting said curvilinear wall.

10. Apparatus for use in chronologically dispensing tablets comprising:

a tablet receiving magazine, having a longitudinal axis, including a plurality of axially spaced groups of circumferentially spaced, concentric, radially outwardly opening, tablet receiving pockets lying in axially spaced, radial planes, which extend transverse to said axis; the pockets of each group being generally longitudinally aligned with the pockets of the axially adjacent groups to form a plurality of circumferentially spaced longitudinally aligned pocket rows;

a plurality of axially abutting, individually rotatable, transparent tablet retaining rings, concentrically mounted on the radially outer surface of said magazine, for rotation about said axis for retaining tablets in said pockets;

one of said plurality of rings and said magazine including a plurality of axially spaced indicia representing the various days of the week on which tablets are to be dispensed;

said magazine including a plurality of circumferentially disposed indicia receiving means for receiving indicia representing different time periods during a day; said plurality of circumferentially spaced indicia being generally longitudinally aligned with said rows;

said rings including tablet dispensing apertures therein for radial registry with any selected one of said pockets to permit tablets in said selected pockets to be radially outwardly dispensed;

said rings and said magazine including cooperating means for releasably locking said rings in any one of a plurality of positions in which said openings are in radial registry with selected ones of said pockets.

11. The apparatus set forth in claim 10 wherein said tablet receiving magazine includes a plurality of circumferentially spaced sets of pocket defining walls, each including radially outwardly extending walls spanned at the radially outer ends thereof by circumferentially extending curvilinear walls; said cooperating means including means for releasably securing said rings in positions in which said dispensing aperture is in radial registry with one of said circumferentially extending walls.

12. The apparatus set forth in claim 11 wherein the circumferential length of said aperture is less than the circumferential length of at least one of said circumferentially extending walls.

13. Apparatus for use in chronologically dispensing tablets comprising:

a tablet receiving cylindrical magazine, having a longitudinal axis, including a plurality of axially spaced groups of annularly arranged, radially outwardly opening, tablet receiving pockets; the pockets of each group lying in radial planes extending transverse to said axis; said pockets being generally longitudinally aligned with the pockets of the axially adjacent groups to form a plurality of circumferentially spaced pocket rows;

transparent, cylindrical, tablet retaining means, concentrically mounted on the radially outer surface of said magazine, for retaining tablets in said pockets;

one of said magazine and said retaining means including a plurality of axially spaced indicia representing the various days of the week on which tablets are to be dispensed; said indicia being generally transversely aligned with said groups of pockets;

said magazine including a plurality of circumferentially disposed indicia representing different time periods during a day, generally longitudinally aligned with said rows;

said tablet retaining means including a plurality of axially spaced tablet dispensing apertures in transverse alignment with said groups of pockets;

one of said magazine and said tablet retaining means including axially abutting radially outer, individually relatively rotatable circumferentially extending sections for relatively rotating said pockets and said apertures into and out of radial registry to permit tablets in any selected ones of said pockets to be radially outwardly dispensed.

14. The apparatus set forth in claim 13 wherein said rotatable sections comprise a plurality of identical, axially abutting, individually rotatable tablet retaining rings mounted on said cylindrical magazine; and end retainer means at opposite ends of said magazine for retaining said rings in axially abutting relation; one of said end retaining rings being removably mounted on said magazine to permit said rings to be axially removed from said magazine.

* * * * *